US006767131B2

(12) United States Patent
Taheri

(10) Patent No.: US 6,767,131 B2
(45) Date of Patent: Jul. 27, 2004

(54) MULTI-COMPARTMENT BAG WITH AN ASYMMETRICAL CLOSURE

(75) Inventor: Nossi Taheri, Atlanta, GA (US)

(73) Assignee: The Bagco, Inc., Atlanta, GA (US)

( * ) Notice: Subject to any disclaimer, the term of this patent is extended or adjusted under 35 U.S.C. 154(b) by 0 days.

(21) Appl. No.: 10/005,278

(22) Filed: Dec. 5, 2001

(65) Prior Publication Data

US 2003/0103692 A1 Jun. 5, 2003

(51) Int. Cl.[7] ..... B65D 33/16

(52) U.S. Cl. ..... 383/63; 383/38; 383/65; 383/102

(58) Field of Search ..... 383/63, 65, 38, 383/102, 103, 66, 2

(56) References Cited

U.S. PATENT DOCUMENTS

| | | | | | |
|---|---|---|---|---|---|
| 3,088,652 | A | * | 5/1963 | Berven | 206/0.5 |
| 3,294,227 | A | * | 12/1966 | Schneider et al. | 206/219 |
| 3,567,463 | A | * | 3/1971 | Williams | 426/124 |
| 4,262,581 | A | * | 4/1981 | Ferrell | 493/188 |
| 4,458,811 | A | | 7/1984 | Wilkinson | |
| 4,637,061 | A | | 1/1987 | Riese | |
| 4,787,755 | A | * | 11/1988 | Branson | 383/65 |
| 4,986,451 | A | * | 1/1991 | Lowe et al. | 99/323 |
| 4,993,844 | A | | 2/1991 | Robinson et al. | |
| 5,024,536 | A | | 6/1991 | Hill | |
| 5,288,415 | A | | 2/1994 | Chen-Wu et al. | |
| 5,352,041 | A | | 10/1994 | Fullerton et al. | |
| 5,709,479 | A | * | 1/1998 | Bell | 383/209 |
| 6,020,013 | A | * | 2/2000 | Kozma | 426/393 |
| 6,030,122 | A | * | 2/2000 | Ramsey et al. | 383/61.2 |
| 6,234,675 | B1 | | 5/2001 | Saad et al. | |
| 6,254,907 | B1 | * | 7/2001 | Galomb | 426/115 |
| 6,395,317 | B1 | * | 5/2002 | Singh et al. | 426/113 |

FOREIGN PATENT DOCUMENTS

| | | | | | |
|---|---|---|---|---|---|
| JP | 406099991 | A | * | 4/1994 | 383/63 |

* cited by examiner

*Primary Examiner*—Jes F. Pascua
(74) *Attorney, Agent, or Firm*—Weatherly & Associates, LLC; Mitchell G. Weatherly

(57) ABSTRACT

A multi-compartment reclosable bag that includes closures that effectively separate the compartments' contents and reduces accidental mixing is described. In addition, perforations in the bag facilitate selective dispensing of a portion of the bag's contents. The reclosable bag includes first and second panels joined along their side edges. An upper closure comprises a male profile having opposing first and second barbs. The first barb is substantially longer than the second barb. An intermediate closure is positioned between the upper closure and a bottom edge of the bag. The intermediate closure comprises a male profile having opposing third and fourth barbs. The third barb is substantially longer than the fourth barb. The first barb is oriented downwardly and the third barb is oriented upwardly for reducing accidental opening of the closures.

17 Claims, 4 Drawing Sheets

MULTI-COMPARTMENT BAG WITH AN ASYMMETRICAL CLOSURE

TECHNICAL FIELD

The present invention relates generally to disposable bags, and more particularly, to a multi-compartment reclosable bag with asymmetrical closures that limit accidental opening of the compartments.

BACKGROUND OF THE INVENTION

Advances in the design and manufacturing of reclosable bags have resulted in reclosable bags being used in various industries, including medicine, jewelry, food packaging, and retail. For example, reclosable bags are widely used in transporting medical specimens. Typical reclosable bags include a reclosable closure (commonly referred to as a zipper) for temporarily securing the bag's contents within a single compartment.

Other types of reclosable bags include multiple compartments. For example, U.S. Pat. No. 4,637,061 issued to Riese includes two chambers with upper and intermediate interlocking fasteners. For this device, a manufacturer thermally seals the fasteners and gripper flaps to a folded plastic sheet. Sealing side edges of this folded sheet forms the bag. Closing the upper fastener seals the bag, while closing the intermediate fastener forms two compartments within the bag.

U.S. Pat. No. 5,288,415 issued to Chen Wu et al. describes a multi-compartment bag. A first reclosable compartment with pores filters liquid from an inner compartment to an outer compartment that surrounds the inner compartment. Using a centrifuge traps larger materials remain within the inner compartment. In contrast, smaller biological agents move from the inner compartment to the outer compartment where they can be dispensed.

Despite the development in the area of reclosable bags, conventional multi-compartment bags remain susceptible to accidental opening of the closures, which can result in unwanted mixing of the compartments' content. In addition, conventional solutions do not selectively dispense the contents of the bag. Thus, a need still exists for a reclosable bag that avoids accidental opening and facilitates selective dispensing of the bag's contents by a user.

SUMMARY OF THE INVENTION

The present invention meets the needs described above in a multi-compartment reclosable bag with asymmetrical closures. The invention is a reclosable bag comprising first and second panels joined along their side edges. An upper closure comprises a male profile having opposing first and second barbs. The first barb is substantially longer than the second barb. An intermediate closure is positioned between the upper closure and a bottom edge of the bag. The intermediate closure comprises a male profile having opposing third and fourth barbs. The third barb is substantially longer than the fourth barb. The first longer barb is oriented downwardly and the third longer barb is oriented upwardly for reducing accidental opening of the closures.

In another form, the invention is a reclosable bag comprising first and second panels joined along their side edges. The invention also includes an upper closure. An intermediate closure is positioned between the upper closure and a bottom edge of the bag. This closure divides the bag into an upper compartment and a lower compartment. At least one of the first and second panels is perforated in the lower compartment for dispensing contents from the bag.

In another form, the invention is a dispenser bag for selectively dispensing aggregate material comprising first and second panels joined along their side edges. An upper closure comprises a male profile having opposing first and second barbs. The first barb is substantially longer than the second barb. An intermediate closure is positioned between the upper closure and a bottom edge of the bag. The intermediate closure comprises a male profile having opposing third and fourth barbs. The third barb is substantially longer than the fourth barb. The first barb is oriented downwardly and the third barb is oriented upwardly for reducing accidental opening of the closures. Closing of the intermediate closure divides the bag into an upper compartment and a lower compartment for receiving the material. At least one of the first and second panels is perforated in the lower compartment.

The invention includes uniquely designed closures that more securely separate the compartments' contents and reduce accidental mixing. In addition, the invention includes an unperforated upper compartment that can store aggregate material and a perforated lower compartment. When desired, a user can open a closure between these compartments to move some of the aggregate material to the perforated lower compartment, from which it can then be dispensed using the perforations. For example, the non-perforated compartment can include potpourri, which maintains its freshness as long as it is in a sealed compartment. By transferring a portion of the potpourri to the perforated compartment, the scent can disperse. However, the portion of the potpourri stored within the sealed upper compartment remains fresh until dispersal is desired.

In view of the foregoing, it will be appreciated that a multi-compartment reclosable bag with asymmetrical closure according to the present invention avoids the drawbacks of prior systems. The specific techniques and structures employed by the invention to improve over the drawbacks of the prior systems and obtain the advantages described herein will become apparent from the following detailed description of the embodiments of the invention and the appended drawings and claims.

DETAILED DESCRIPTION OF THE EMBODIMENTS

In describing the embodiments of the present invention, specific terminology is employed for the sake of clarity. The invention, however, is not intended to be limited to the specific terminology so selected.

Figure 1A:
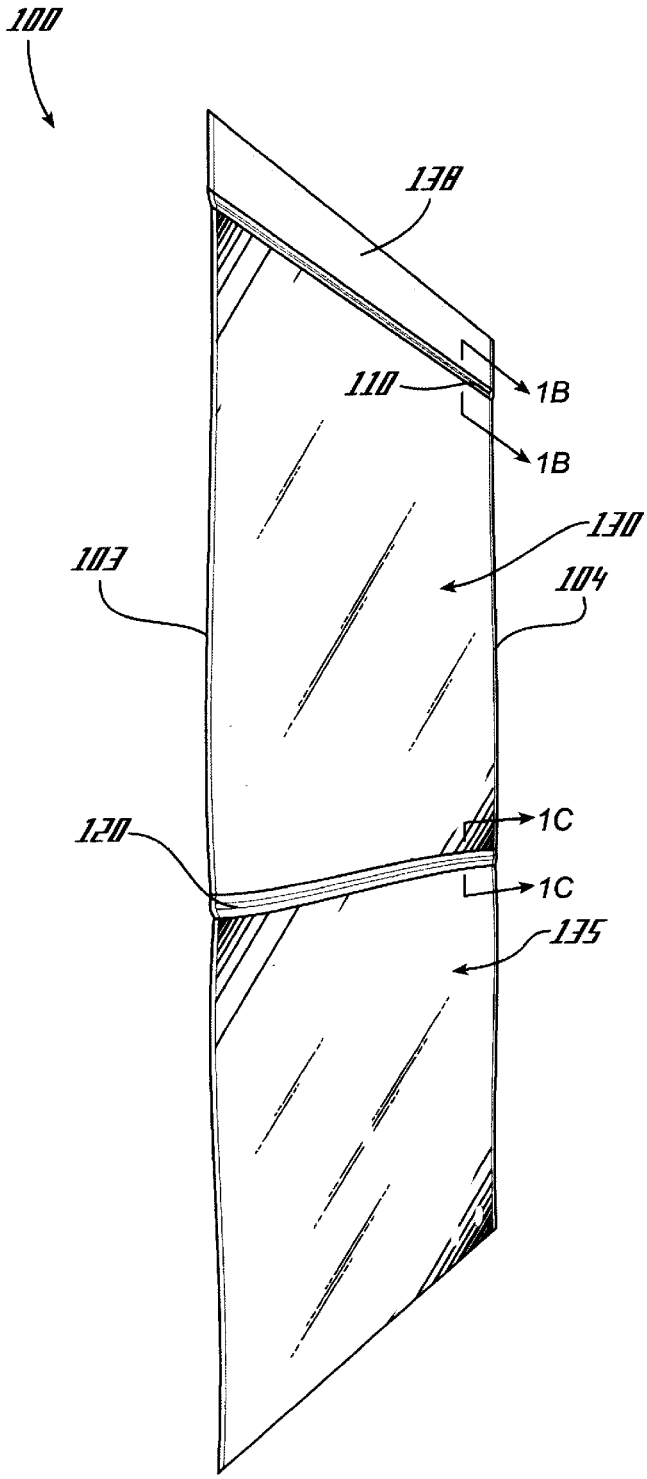
FIG. 1A is a perspective view of a reclosable bag illustrating a first embodiment of the invention.

FIG. 1A is a perspective view of a reclosable bag 100 illustrating a first embodiment of the invention. The reclosable bag 100 includes a front panel and a rear panel connected along the side edge 103 and the side edge 104 by heat sealing. These panels can be formed from a single sheet of laminated material that includes nylon, polyethylene, polypropylene, or some other suitable polymer. In addition, these panels can include decorative designs that make the bag 100 more appealing. For example, the panels' design could include cartoon characters easily recognizable by children. In addition, the thickness of these panels can vary depending upon the application. For example, the panels can be 2-mil, 4-mil, 6-mil, or some other suitable thickness.

Figure 1B:
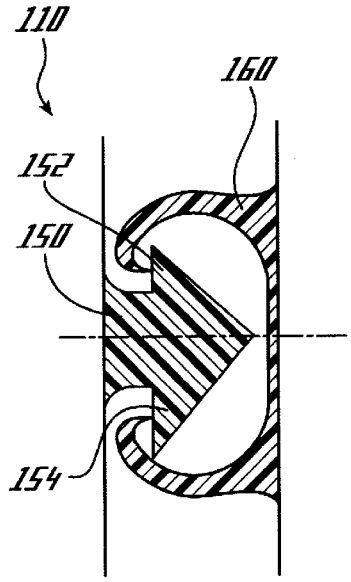
FIG. 1B is a cross-sectional view of an upper closure portion of the bag of FIG. 1A illustrating a double barbed male profile and a female profile within the upper closure.

The bag 100 also includes two closures 110, 120 extruded from the same sheet of material that forms the panels with side edges 103, 104. Closing an intermediate closure 120 can separate the bag 100 into an upper compartment 130 and a lower compartment 135. The closure 110 and the closure 120 comprise a zipper having mating male and female profiles, or locking elements. FIG. 1B is a cross-sectional view illustrating a double barbed male profile 150 and a female profile 160 within the upper closure 110. To seal the upper closure 110, a user inserts the double barbed male profile 150 into the female profile 160. The double barbed male profile 150 includes a barb 152 and a barb 154 positioned opposite of each other. Once inserted, the female profile 160 captures the barb 152, which seals the upper closure 110.

The asymmetrical design of this double barbed male profile creates a sturdy seal. The barb 154 is substantially longer than the barb 152. In addition, the longer barb 154 points towards a lower portion of the upper compartment 130. Objects stored within the upper compartment 130 can exert a force on the upper closure 110. The force can result from either the objects' weight or bag expansion from the objects' presence. Positioning the longer barb 154 towards a lower portion of the upper compartment 130 helps counteract the impact of these forces. The additional length creates a distance labeled "A" that must be overcome before the barb 154 is free from the female profile 160. Because the closure 110 is made from a heavy-duty material, the male profile 150 and female profile 160 remain somewhat resistant to bending. To overcome the distance A and the resistance to bending, a greater force is needed to open the closure 110 from inside the upper compartment 130. In contrast, orienting the shorter length barb 152 towards the lips 138 results in a user exerting little effort in pulling apart the lips 138. Thus, the asymmetrical design of the closure 110 facilitates easy deliberate opening by a user, while minimizing accidental opening from the inside of the upper compartment 130.

Figure 1C:
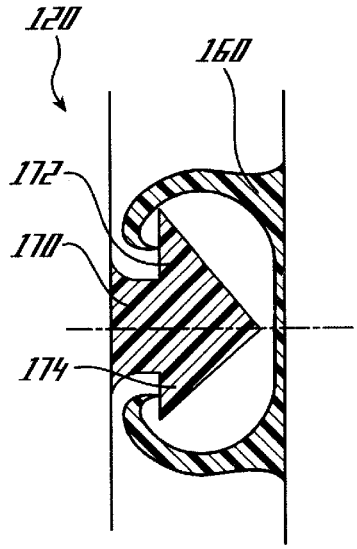
FIG. 1C is a cross-sectional view of a lower closure portion of the bag of FIG. 1A illustrating a double barbed male profile and a female profile within the lower closure.

FIG. 1C is a cross-sectional view illustrating a double barbed male profile 170 and a female profile 160 within the lower closure 120. The double barbed male profile 170 is also asymmetrical and includes opposing barb 172 and barb 174. The barb 172 is substantially longer than the barb 174. Like the barb 154, the longer barb 172 is oriented towards the upper compartment 130, which reduces accidental opening of the closure 120 from the inside of the upper compartment 130. Orienting the shorter barb 174 towards the lower compartment 135 facilitates easy opening from the bottom of the bag 200. Thus, the weight of articles stored in the compartment 130 generally does not force the closure 120 open. But a user can easily open the closure 120 as described with reference to FIGS. 2A–2B.

Figure 2A:
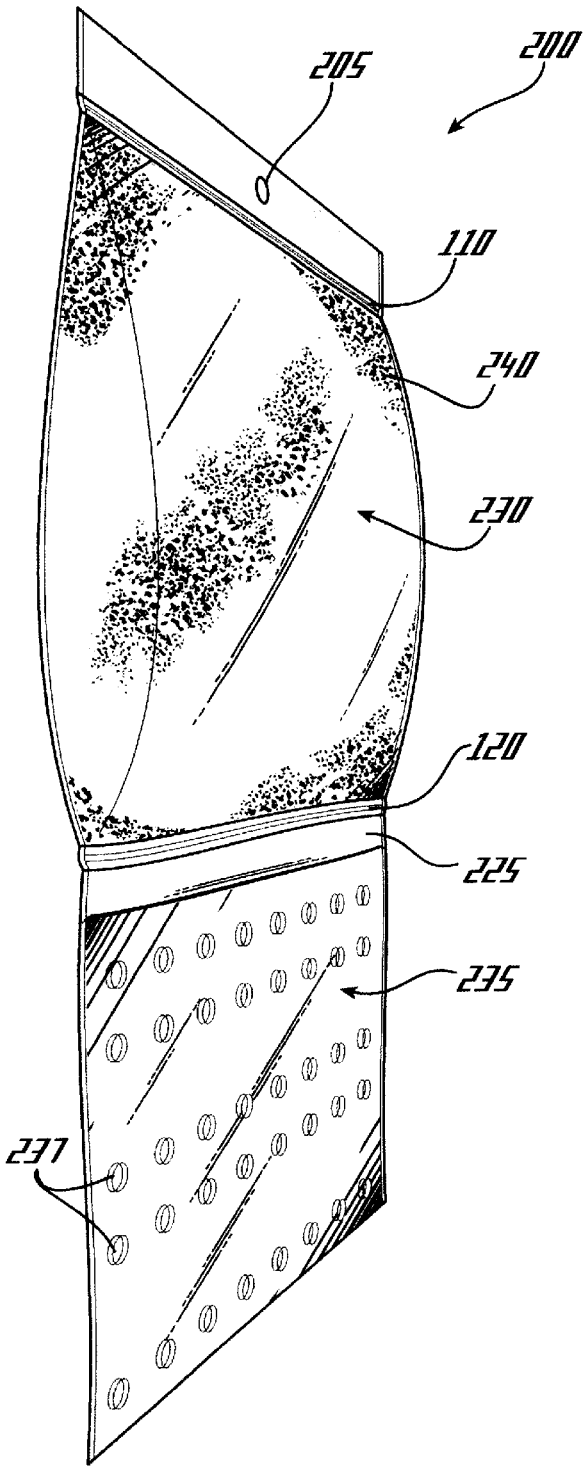
FIG. 2A is a perspective view of a perforated reclosable bag illustrating a second embodiment of the invention.

FIG. 2A is a perspective view of a perforated reclosable bag 200, or dispenser bag, illustrating a second embodiment of the invention. The bag 200 includes a hang hole 205 for effectively suspending this bag during storage or dispersal. Within this bag, the upper compartment 230 can contain some type of loose aggregate material 240. This material could be seeds, potpourri, fertilizer, mothballs, powder, pellets, or some other suitable material.

Figure 2B:
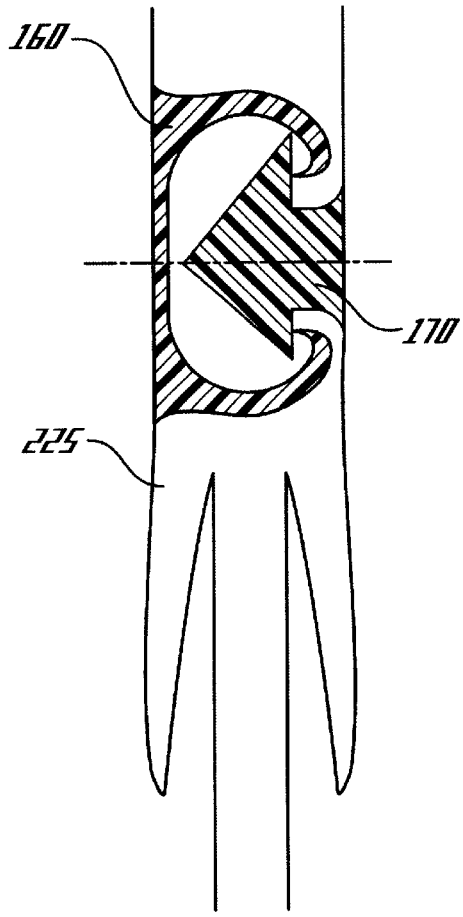
FIG. 2B is a cross-sectional view of a lower closure portion of the bag of FIG. 2A with a gusset that forms an attached lip.

The bag 200 also includes lips 225 for opening the intermediate closure 220. A manufacturer forms these lips by forming a permanent fold in the front and rear panels of the bag 200. Thus, the bag 200 includes integrated closures 110, 120 and integrated lips 225 that form a unitary structure. FIG. 2B is a cross-sectional view of the closure 120 with lips 225. As shown, the closure 120 includes the male profile 170 and the female profile 160. The lips 225 are formed as gussets below the closure 120. By pulling both lips 225 apart, a user can open the closure 120 easily. After opening this closure, the material 240 flows from the upper compartment 230 to the lower compartment 235.

The lower compartment 235 includes numerous perforations 237 used in dispensing the aggregate material 240. The perforations 237 can be randomly arranged throughout the lower compartment 135. For example, a front panel can include perforations while the back panel does not. Alternatively, the lower compartment could be partially perforated or unperforated. In addition, these perforations can be various shapes and sizes. For example, small perforations can facilitate a slow dispensing of birdseed that flows into the lower compartment 235.

Figure 3A:
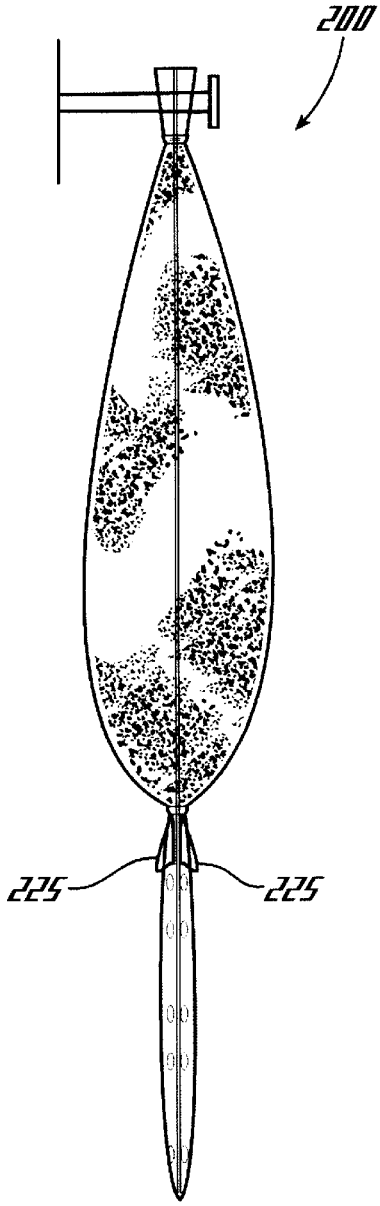
FIG. 3A is a side view of the bag of FIG. 2A illustrating suspension of the bag when the closures are sealed.
Figure 3B:
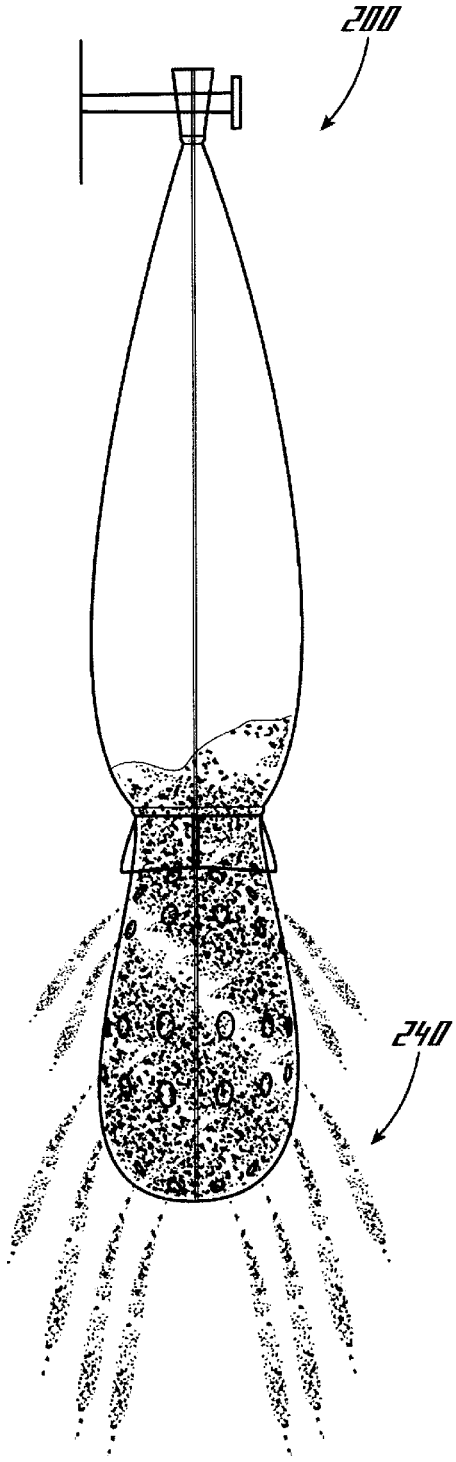
FIG. 3B is a side view of the bag of FIG. 3A illustrating dispensing of the articles in the bag.

Turning now to FIG. 3A, FIG. 3A is a side view of the bag 200 illustrating suspension of the bag 200 when the closures 110, 120 are sealed. As described with reference to FIG. 2A, the bag 200 can include a hang hole 205. To suspend the bag 200, a fastener such as a nail, screw, peg, hook or some other suitable device can connect the bag 200 to a board or tree, for example. Because the bag 200 includes the articles 240 and is suspended, the weight of the articles exerts considerable force on the upper closure 110 and the lower closure 120 illustrated in FIG. 2A. The asymmetrical nature of the double barbed male profiles 170, 172 shown in FIG. 1B causes the upper closure 110 and the lower closure 120 to remain sealed as shown in FIG. 3A. FIG. 3B is a side view of the bag 200 illustrating dispensing of the articles 240 in the bag 200. A user can open the lower closure 120 using the lips 225, which allows the content of the bag 200 to flow freely to the upper compartment 230 to the lower compartment 235. Some of the articles 240 that flow into the lower compartment 235 flow from the bag 200 through the perforations 237. In this manner, the articles 240 previously stored in the upper compartment 235 can be selectively dispensed.

Figure 4:
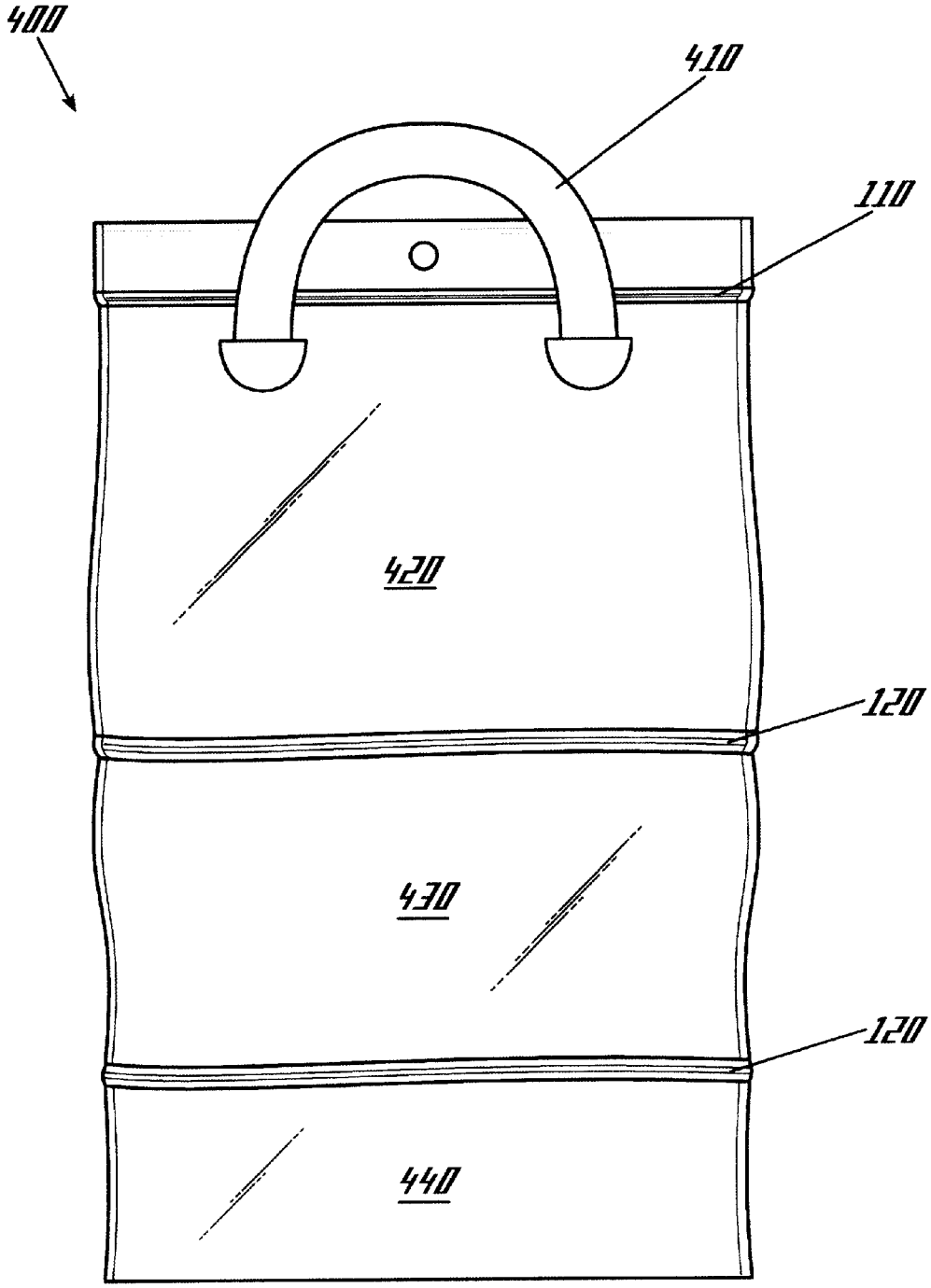
FIG. 4 is a front view of a reclosable bag illustrating a third embodiment of the invention.

FIG. 4 is a side view of a multi-compartment bag 400 illustrating a handle 410 for carrying the bag 400. The size shape and position of the handle 410 can vary depending upon design constraints. For example, using the bag 400 as a disposable lunch kit for school children can warrant making the handle 410 small, sturdy and thin. In addition to the handle 410, the bag 400 includes compartments 420–440. The size of these compartments can vary depending upon uses. For the above example, the compartment 420 can be sized for a sandwich and the compartment 430 can be sized for some chips. In contrast, the compartment 440 can be sized for snacks such as carrots, raisins, or grapes. Using this bag, a mother can effectively store a child's lunch in a single disposable bag, for example.

Like the bag 200, the bag 400 includes closures 110, 120 that form the compartments 420–440 when closed. Because the bag 400 includes three compartments, two of the closures 120 are used. Since the closures 110, 120 include an asymmetrical design, the accidental opening from the inside of each of the compartments in the bag 400 is minimized. Though not shown, lips 225 can be used with the compartments 430, 440. In addition, any one of these compartments could include perforations.

In view of the foregoing, it will be appreciated that present invention provides a multi-compartment reclosable bag. This bag includes closures that create sturdy seals and hinder accidental opening the bag. In addition, perforations in the bag facilitate selective dispensing of a portion of the bag's contents. A multi-compartment bag with asymmetrical closures can be used in various storage applications involving prepackaged salads and disposable lunch containers. When used in dispensing, the invented bag creates several advantages by limiting human contact with the aggregate material. For example, lawn care workers can avoid direct contact with a potentially harmful fertilizer stored in the upper compartment and dispensed in the perforated lower compartment. In addition, cleaning up birdseed after filling the birdfeeder is simplified by using the invented bag for dispensing.

It should be understood that the foregoing relates only to the exemplary embodiments of the present invention, and that numerous changes can be made therein without departing from the spirit and scope of the invention as defined by the following claims.

The invention claimed is:

1. A perforated reclosable bag comprising:

first and second panels joined along side edges thereof;

an upper closure;

an intermediate closure positioned between the upper closure and a bottom edge of the bag and dividing the bag into an upper compartment and a lower compartment; and wherein at least one of the first and second panels is perforated in the lower compartment, wherein the upper closure comprises a male profile having opposing first and second barbs, wherein the first barb is substantially longer than the second barb;

the intermediate closure comprises a male profile having opposing third and fourth barbs, wherein the third barb is substantially longer than the fourth barb; and wherein the first barb is oriented downwardly and the third barb is oriented upwardly for reducing accidental opening of the closures.

2. A multi-compartment reclosable bag for reducing accidental opening comprising: first and second panels joined along side edges thereof;

an upper closure comprising a male profile having opposing first and second barbs, wherein the first barb is substantially longer than the second barb;

an intermediate closure positioned between the upper closure and a bottom edge of the bag, the intermediate closure comprising a male profile having opposing third and fourth barbs, wherein the third barb is substantially longer than the fourth barb; and wherein the first barb is oriented downwardly and the third barb is oriented upwardly for reducing accidental opening of the closures; and a lower closure positioned between the intermediate closure and the bottom of the bag, the lower closure comprising a male profile having opposing fifth and sixth barbs, wherein the fifth barb is substantially longer than the sixth barb, and the fifth barb is oriented upwardly and the sixth barb is oriented downwardly.

3. A reclosable bag as claimed in claim 2 wherein closing of the intermediate closure and the lower closure divides the bag into an upper compartment, middle compartment, and lower compartment.

4. A dispenser bag for selectively dispensing aggregate material comprising:

first and second panels joined along side edges thereof;

an upper closure comprising a male profile having opposing first and second barbs, wherein the first barb is substantially longer than the second barb;

an intermediate closure positioned between the upper closure and a bottom edge of the bag, the intermediate closure comprising a male profile having opposing third and fourth barbs, wherein the third barb is substantially longer than the fourth barb; and wherein the first barb is oriented downwardly and the third barb is oriented upwardly for reducing accidental opening of the closures, and wherein closing of the intermediate closure divides the bag into an upper compartment and a lower compartment for receiving the material, wherein at least one of the first and second panels is perforated in the lower compartment for dispensing the aggregate material.

5. A dispenser bag as claimed in claim 4 further comprising first and second lips positioned along the intermediate closure for grasping by a user to facilitate opening of the intermediate closure.

6. A dispenser bag as claimed in claim 5 wherein pulling the lips apart opens the upper compartment to the lower compartment and allows aggregate material to flow from the upper compartment to the lower compartment for dispensing.

7. A dispenser bag as claimed in claim 4 wherein the bag is formed from a single sheet of material.

8. A dispenser bag as claimed in claim 4 further comprising a handle for carrying the bag.

9. A reclosable bag, comprising:

A. a bag panel,
  i. a first panel,
  ii. a second panel,
  iii. a top edge, and
  iv. a bottom edge;

B. an upper closure, comprising an upper male profile connected to the bag panel and a complementary upper female profile connected to the bag panel;

C. an intermediate closure positioned between the upper closure and the bottom edge of the bag panel to define an upper compartment of the bag and a lower compartment of the bag, comprising:
  i. an intermediate male profile connected to the bag panel having a first barb and a second barb such that the first barb is:
    a. oriented toward the top edge and
    b. substantially longer than the second barb; and
  ii. a complementary intermediate female profile connected to the bag panel; in which the upper male profile further comprises a third barb and a fourth barb such that the third barb is oriented toward the bottom edge and substantially longer than the fourth barb.

10. A bag according to claim 9, further comprising a plurality of perforations in the bag panel.

11. A bag according to claim 10, in which the perforations are located in the lower compartment of the bag.

12. A bag according to claim 10, in which the perforations are located in the upper compartment of the bag.

13. A bag according to claim 10, in which the perforations are located in the upper compartment of the bag and in the lower compartment of the bag.

14. A reclosable bag, comprising:

A. a bag panel defining:
  i. a first panel,
  ii. a second panel,
  iii. a top edge, and
  iv. a bottom edge;

B. an upper closure, comprising an upper male profile connected to the bag panel and a complementary upper female profile connected to the bag panel;

C. an intermediate closure positioned between the upper closure and the bottom edge of the bag panel to define an upper compartment of the bag and a lower compartment of the bag, comprising:
  i. an intermediate male profile connected to the bag panel having a first barb and a second barb such that the first barb is:
    a. oriented toward the top edge and
    b. substantially longer than the second barb; and
  ii. a complementary intermediate female profile connected to the bag panel; and D. a lower closure positioned between the intermediate closure and the bottom edge of the bag panel, comprising:
  i. a lower male profile connected to the bag panel and
  ii. a complementary lower female profile connected to the bag panel.

15. A bag according to claim 14 in which the lower male profile further comprises a fifth barb and a sixth barb such that the fifth barb is:

A. oriented toward the top edge and

B. substantially longer than the sixth barb.

16. A reclosable bag, comprising:

A. a bag panel defining:
  i. a first panel,
  ii. a second panel,
  iii. a top edge, and
  iv. a bottom edge;

B. an upper closure, comprising an upper male profile connected to the bag panel and a complementary upper female profile connected to the bag panel;

C. an intermediate closure positioned between the upper closure and the bottom edge of the bag panel to define an upper compartment of the bag and a lower compartment of the bag, comprising:
  i. an intermediate male profile connected to the bag panel having a first barb and a second barb such that the first barb is:
    a. oriented toward the top edge and
    b. substantially longer than the second barb; and
  ii. a complementary intermediate female profile connected to the bag panel;

D. a first lip connected to the first panel near the intermediate closure and defining a first free lip edge; and E. a second lip connected to the second panel near the intermediate closure and defining a second free lip edge.

17. A bag according to claim 16, in which:

A. the first lip is connected to the first panel at a position between the intermediate closure and the bottom edge of the bag and B. the second lip is connected to the second panel at a position between the intermediate closure and the bottom edge of the bag.

* * * * *